United States Patent [19]

Lutzenberger

[11] Patent Number: 4,652,067

[45] Date of Patent: Mar. 24, 1987

[54] ELECTRICAL CONNECTOR WITH AN INTERNAL SWITCH

[75] Inventor: Kurt Lutzenberger, Arlington Hts., Ill.

[73] Assignee: Switchcraft, Inc., Chicago, Ill.

[21] Appl. No.: 805,690

[22] Filed: Dec. 6, 1985

[51] Int. Cl.[4] ..... H01R 25/00; H01R 29/00; H01R 33/96

[52] U.S. Cl. ..... 339/18 P; 200/51.09

[58] Field of Search ..... 200/51.09; 339/36, 40, 339/42, 111, 18 P

[56] References Cited

U.S. PATENT DOCUMENTS 3,391,262 7/1968 Twitchell ..... 200/51.09

FOREIGN PATENT DOCUMENTS 1006906 4/1957 Fed. Rep. of Germany ... 200/51.09

2030264 12/1971 Fed. Rep. of Germany ... 200/51.09

*Primary Examiner*—E. Michael Combs

*Attorney, Agent, or Firm*—William R. Clark; Richard M. Sharkansky

[57] ABSTRACT

A male plug connector having terminals coupled to the signal leads of an electrical circuit for switching the signal leads dependent upon interfitting or separating the male connector with a mating female connector. First, second and third electrodes longitudinally extend through a post-like insulating base thereby defining three respective male pins protruding from the mating face of the base and three respective terminals protruding from the opposing face of the base. A fourth electrode protrudes only from the opposing face to define a fourth terminal. A spring loaded plunger is slidably positioned in the base and protrudes from the mating face of the base. The plunger is mechanically linked to an axially sliding switch which has three interconnected contact arms aligned with the second, third and fourth electrodes. During interfittment of the connectors, the plunger is inwardly deflected by the face of the female connector thereby electrically interconnecting the third and fourth terminals. When the connectors are apart, the spring outwardly deflects the plunger thereby electrically connecting the second terminal to the third terminal.

5 Claims, 6 Drawing Figures

ELECTRICAL CONNECTOR WITH AN INTERNAL SWITCH

BACKGROUND OF THE INVENTION

The invention relates generally to electrical connectors such as, for example, connectors suitable for use in audio systems. Condensor microphones, having an internal preamplifier powered by an internal battery, are coupled to external audio amplifiers by conventional male and female connectors. The microphone handle typically has a manually operated electrical switch to disconnect the battery from the preamplifier during standby times when the connectors are apart. Otherwise, the preamplifier would drain battery power unnoticed by those using the audio equipment. A disadvantage with the manual switch is that the operator may negligently leave the switch on resulting in a dead battery. Another problem is that electrostatic charges may couple to the microphone audio output through the disconnected connector, possibly damaging internal preamplifier components such as, for example, a Field Effect Transistor. Although this problem may be addressed by manually connecting the microphone audio to common when the connectors are apart, this approach is also subject to operator negligence. In addition, use of manual switches requires numerous wiring and soldering steps during assembly.

SUMMARY OF THE INVENTION

The present invention overcomes the above and other disadvantages of the prior art by the provision of an electrical connector for detachable interfittment with a mating electrical connector, comprising the combination of an insulating or dielectric base having a mating face and an opposing face, the base having a cavity communicating with the mating face, the base further having first and second passageways extending between the cavity and the opposing face, a first electrical conductor or electrode positioned in the first passageway and protruding from the opposing face providing a first terminal, a second electrical conductor positioned in the second passageway and protruding from the opposing face providing a second terminal, the first and second terminals being adapted to connect with the signal leads of an electrical circuit, an axially slidable switch positioned within the cavity, the switch electrically connecting the first and second conductors in a first axial position and electrically disconnecting the first conductor from the second conductor in a second axial position, and spring biased means extendable from the mating face and responsive to interfittment of the connector with the mating connector for moving the switch axially between the first and second positions. The first and second terminals may be wired in series with an electrical circuit connected thereto such as, for example, a condensor microphone for providing electrical switching therein dependent upon either interfittment or separation of the connectors.

The invention may also be practiced by an electrical male plug connector adapted for detachable insertion into the conductive receptacles on the face of a female connector, comprising a substantially cylindrical insulating base having a mating face and an opposing face, the base also having a cavity, first and second passageways extending between the mating and opposing faces, the first and second passageways also extending through the cavity, a third passageway extending between the cavity and the opposing face, first and second electrodes respectively positioned in the first and second passageways, the first and second electrodes protruding from the mating face respectively providing first and second pins for mating with the female connector, the first and second electrodes also protruding from the opposing face providing first and second conductor terminals, a third electrode positioned in the third passageway and protruding from the opposing face providing a third conductor terminal, a channel extending between the mating face and the cavity, a plunger slidably positioned in the channel, the plunger protruding beyond the mating face and being adapted to be slidably deflected into the cavity by the female face when the male connector pins are inserted into the female conductive receptacles, a spring connected between the plunger and the base to slidably deflect the plunger out of the cavity when the male connector pins are disconnected from the female receptacles, and an axially slidable switch positioned within the cavity and coupled to the plunger, the switch electrically connecting the first electrode to the second electrode in response to deflection of the plunger out of the cavity and electrically connecting the second electrode to the third electrode in response to deflection of the plunger into the cavity.

BRIEF DESCRIPTION OF THE DRAWINGS

The foregoing and other objects and advantages of the invention will be more readily understood by reading the Description of the Preferred Embodiment wherein.

DESCRIPTION OF THE PREFERRED EMBODIMENT

Figure 1:
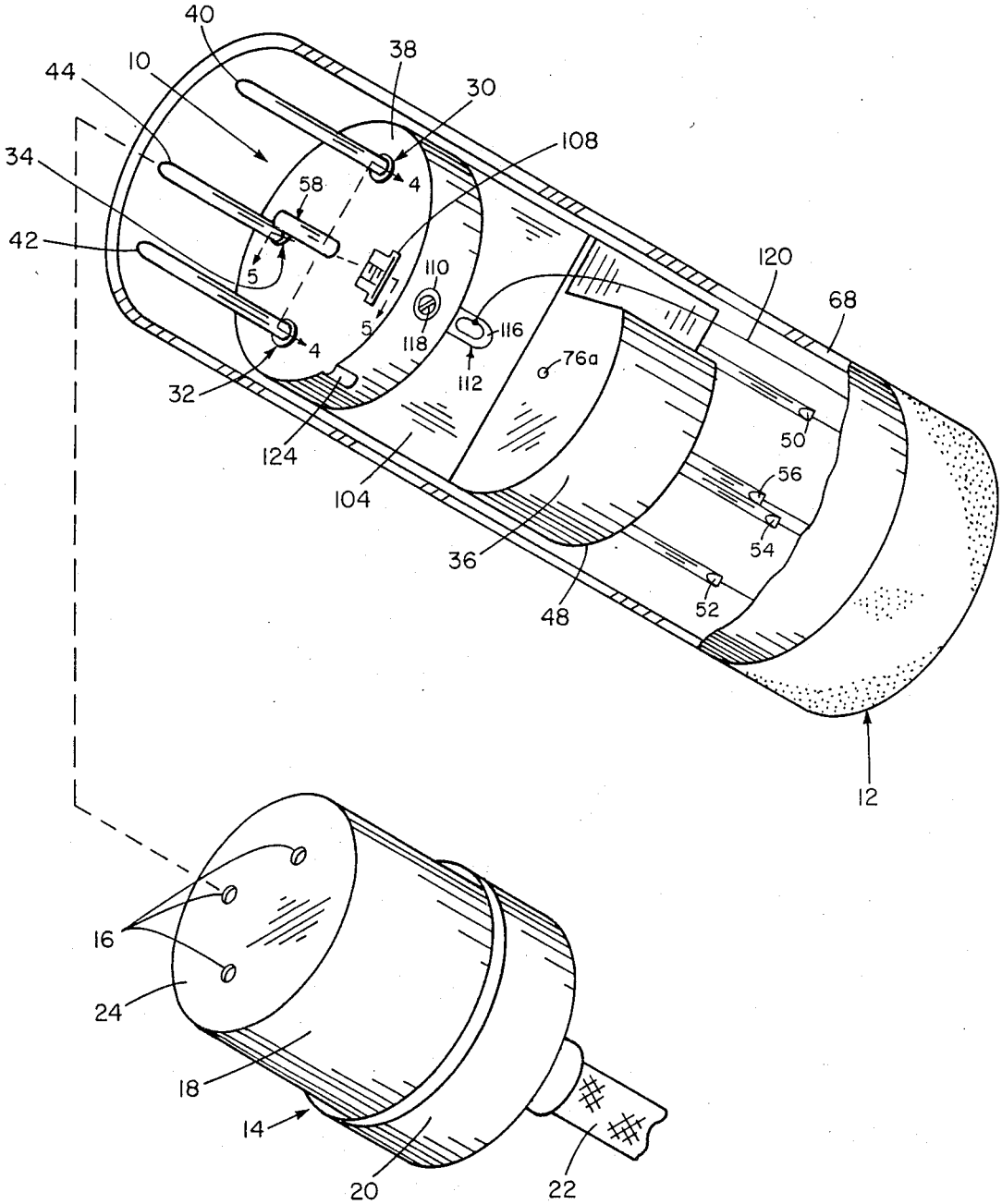
FIG. 1 is an illustrative perspective view of male plug connector 10 embodying the invention.
Figure 3:
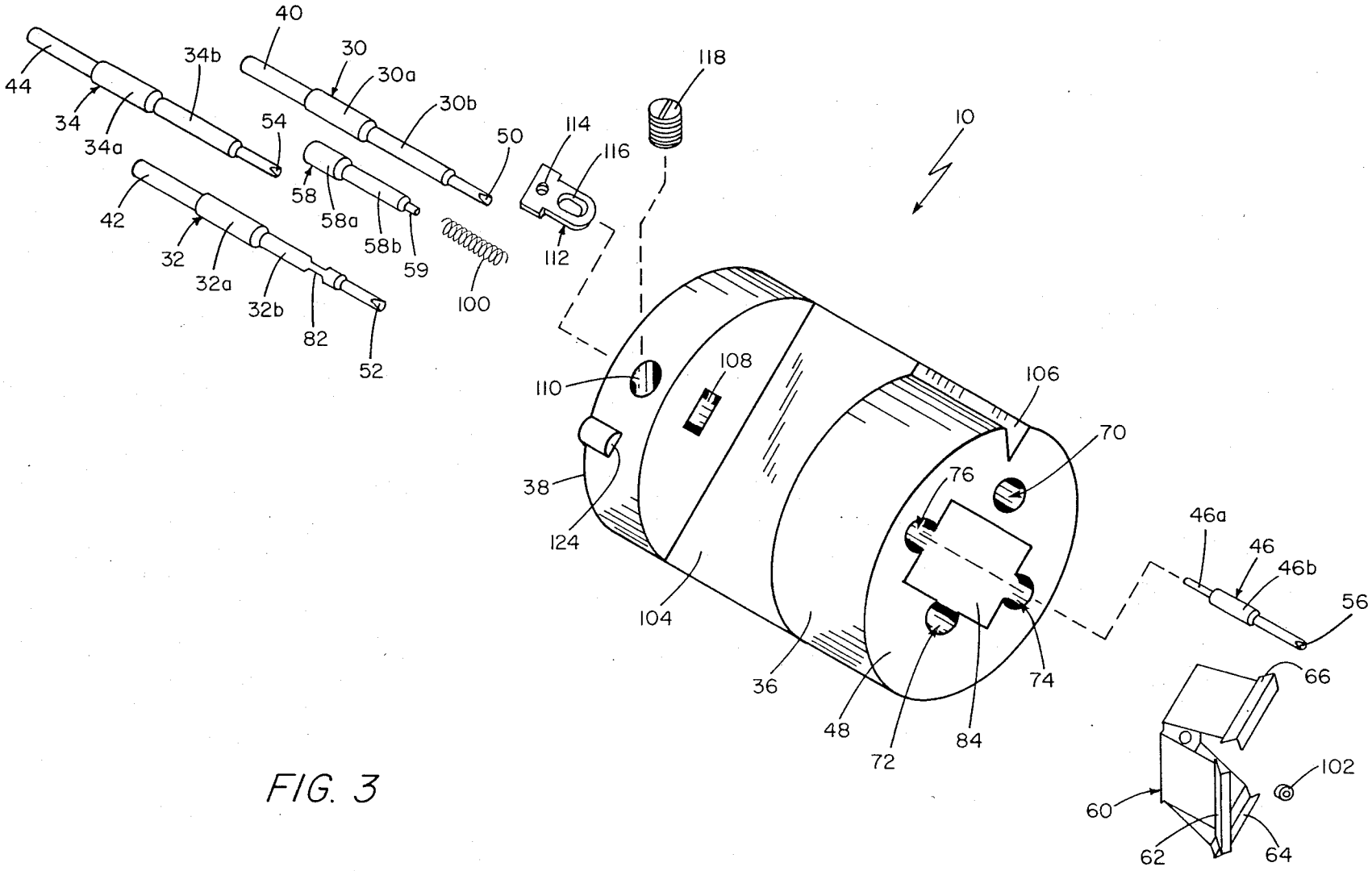
FIG. 3 is an exploded, perspective view illustrating the components of male plug connector 10.

Referring to the drawings, particularly FIG. 1, male plug connector 10 is broadly illustrated for detachably coupling two electrical circuits such as, for example, a condenser microphone 12 and an audio amplifier (not shown). The respective circuits are interconnected by detachably interfitting male connector 10 and female connector 14. For illustrative purposes, female connector 14 is shown having conventional components including conductive pin receptacles 16 which are spatially separated by face 24 of dielectric base 18, electrically shielded by conductive housing 20 and coupled to audio cable 22. The principal components of male connector 10 include substantially cylindrical insulating base 36, preferably of molded high strength thermoset, having a mating face 38, opposing face 48 and cavity 84 (FIG. 3). Passageways 70, 72 and 74 extend between faces 38 and 48; passageway 76 extends between cavity 84 and face 48 (FIG. 5). Electrodes or conductors 30, 32 and 34, preferably of a silver plated copper alloy with a clear chromate coating, are respectively positioned within passageways 70, 72 and 74, and protrude from face 38 to respectively define male connector pins 40, 42 and 44. The electrodes 30, 32 and 34 also protrude from opposing face 48 to define respective conductive terminals 50, 52 and 54. An electrode 46 (FIG. 3) is positioned in passageway 76 and protrudes from face 48 to define terminal 56. Terminals 50, 52, 54 and 56 are adapted to provide electrical connection with electrical circuitry such as, for example, microphone 12. As will be described in more detail hereinafter with particular reference to FIGS. 3, 4A and 5, a spring biased means 128 broadly including plunger 58, spring 100 and passageway 98 is connected between face 38 and axially slidable switch 61. The axially slidable switch 61 broadly includes sliding contact member 60, conductive surface areas 92, 94 and 96, and non-conductive surface areas 88 and 89. Electrodes 30, 32 and 34 are coupled to slidable switch 61. Plunger 58 protrudes from face 38 such that plunger 58 is deflected therein by face 24 of female connector 14 when male connector pins 40, 42, and 44 are inserted into respective female receptacles 16. In response, as described later herein, slidable switch 61 will electrically connect terminal 54 to terminal 56 when connectors 10 and 14 are interfitted, or electrically connect terminal 54 to terminal 52 when connectors 10 and 14 are apart.

Figure 2:
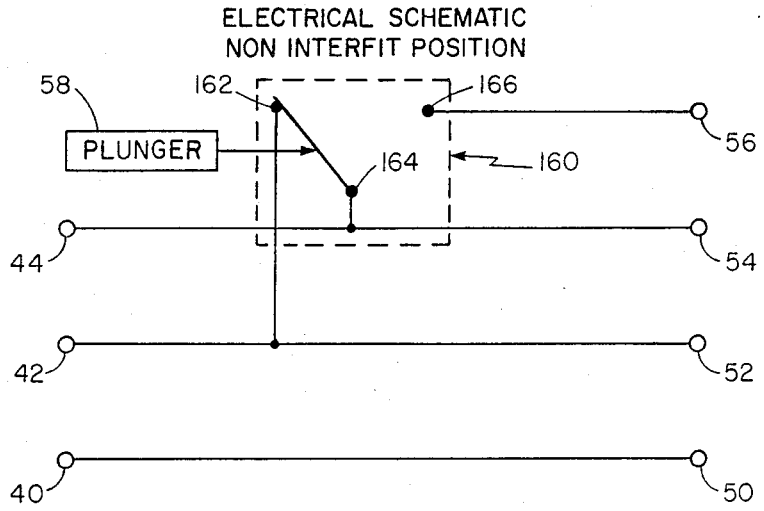
FIG. 2 is an electrical schematic illustrating the electrical switching within male plug connector 10.

The electrical switching described above is schematically shown in FIG. 2. A single pole double throw switch 160 is shown in the normally closed position when connectors 10 and 14 are not interfitted. Switch 160 includes normally closed contact point 162 connected to terminal 52, pole 164 connected to terminal 54 and normally open contact point 166 connected to terminal 56. Plunger 58 is shown coupled to switch 160. Accordingly, when connectors 10 and 14 are not interfitted, terminals 52 and 54 are electrically coupled together. Conversely, when connectors 10 and 14 are interfitted, plunger 58 will throw switch 160 thereby disconnecting terminal 52 from terminal 54 and connecting terminal 54 to terminal 56.

In general, connector 10 may be used to provide automatic switching in an electrical device wherein the switching is dependent only upon interfittment of the connectors. Those skilled in the art will recognize many applications where connector 10 may be used to advantage. For example, in the embodiment illustrated in FIG. 1, terminals 52 and 54 may be respectively coupled to the common and audio (not shown) of condenser microphone 12. Terminals 54 and 56 may be connected in series with the internal battery and amplifier (not shown) of microphone 12. In this manner, current is only drawn from the battery when the series circuit through pins 54 and 56 is completed during interfittment. Inadvertent drainage of battery power from a disconnected microphone is thereby avoided. Further, when connectors 10 and 14 are apart, the microphone audio is coupled to common through pins 52 and 54 thereby protecting internal microphone components from damage by electrostatic charge.

It should also be noted that in the embodiment illustrated microphone housing 68 provides electrical shielding for male connector 10. A separate shield similar to, for example, conductive housing 20 of female connector 14 may also be utilized. Those skilled in the art will also recognize that the teachings of the present invention may be equally applied to a female connector such as female connector 14.

Referring now to FIGS. 3, 4A, 4B and 5 a more detailed description of male connector 10 is given. Hollow cylindrical passageway 70 longitudinally extends through base 36 for receiving electrode 30. Passageway 70 includes longitudinal segment 70*a* which extends into face 38 and narrower segment 70*b* which extends into face 48. Electrode 30 includes segment 30*a* and narrower segment 30*b* with diameters adapted for enclosure by passageway segments 70*a* and 70*b*, respectively. Thus, electrode 30 may be slidably inserted through face 38 into passageway segments 70*a* and 70*b* for proper alignment within base 36. The constriction 71 between passageway segment 70*a* and narrower segment 70*b* forms a rest stop for insertion of electrode 30.

Like passageway 70, hollow cylindrical passageways 72 and 74 longitudinally extend through base 36 for receiving respective electrodes 32 and 34. Passageway 72 includes segment 72*a*, narrower segment 72*b*, and rest stop 73 formed therebetween, adapted to receive respective electrode segments 32*a* and 32*b*. Similarly, passageway 74 includes segment 74*a*, narrower segment 74*b*, and rest stop 74 formed therebetween, adapted to receive respective electrode segments 32*a* and 32*b*. Electrode segment 32*b* includes recessed area 82, the purpose of which will be explained later herein.

Hollow cylindrical passageway 76 longitudinally extends from face 48 into base 36 for receiving electrode 46. Passageway 76 includes longitudinal segment 76*b* extending through face 48, narrower segment 76*a* and rest stop 77 formed therebetween. Electrode 46 includes segment 46*a* and wider segment 46*b* adapted for insertion into passageway 76. For reasons described hereinafter, passageway 76*b* extends between a position 80 in base 36, radially opposite recessed area 82 of electrode segment 32*b*, to face 48.

Passageways 70, 72, 74 and 76 are positioned approximately 90° apart along approximately the same arc around the axis of base 36. Therefore, terminals 50, 52, 54 and 56 will be positioned approximately 90° apart on face 48; and male connector pins 30, 32 and 34 will be positioned approximately 90° apart on face 38 of base 36.

Base 36 also includes a longitudinal rectangular cavity 84 adjacent to face 48. Cavity 84 is adapted to intersect passageway segments 72*b*, 74*b* and 76*b* thereby exposing respective conductive surfaces 92, 94 and 96 of respective electrodes 32, 34 and 46 to cavity 84. Conductive surfaces 92, 94 and 96 protrude into cavity 84. However, non-conductive surface areas 88 and 89 are positioned over portions of respective electrodes 32 and 46 within cavity 84. More particularly, recessed area 82 of electrode 32 is of sufficient depth to prevent recessed area 82 from protruding into cavity 84 thereby defining non-conductive surface area 88 over electrode 32. Further, passageway segment 76*b* extends from a position 80 within cavity 84 to face 48 thereby defining non-conductive surface area 89 which covers electrode 46 before position 80.

Figure 4A:
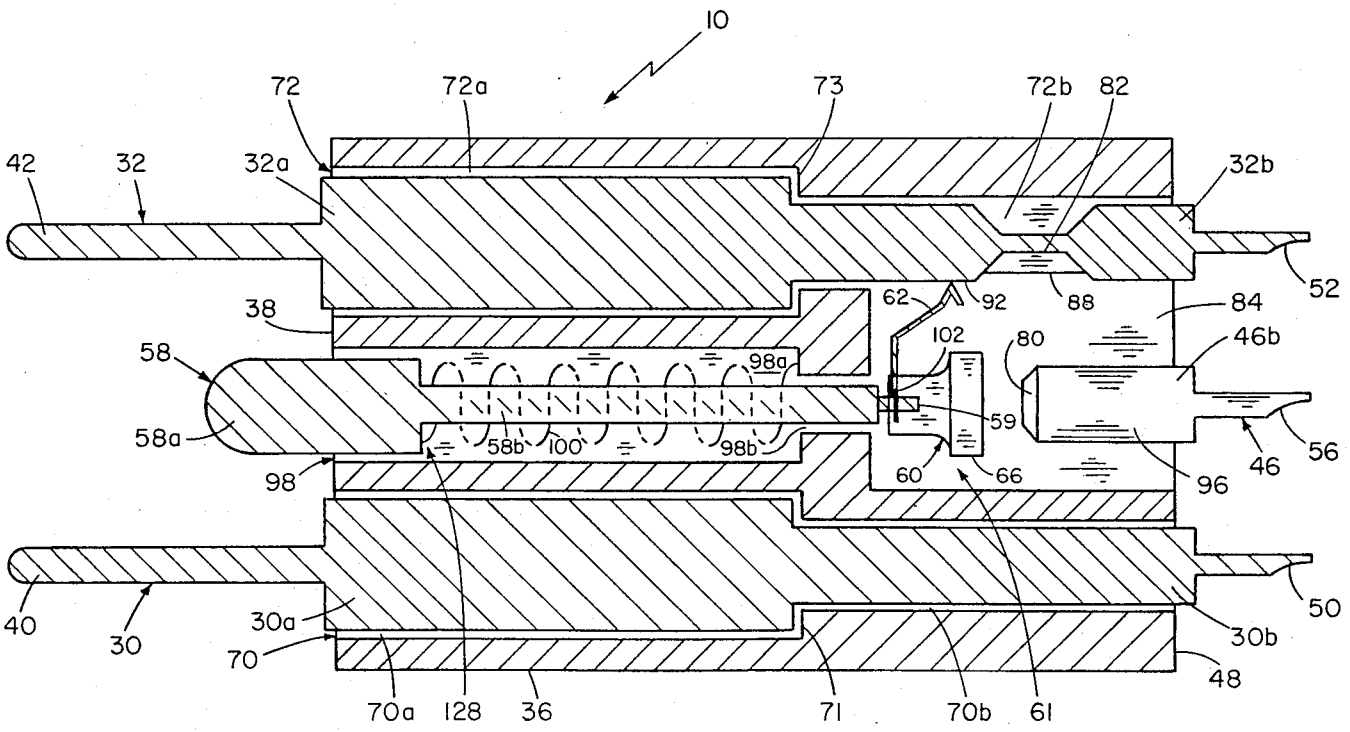
FIG. 4A is a cross-sectional view of male plug connector 10 taken along line 4—4 of FIG. 1.
Figure 5:
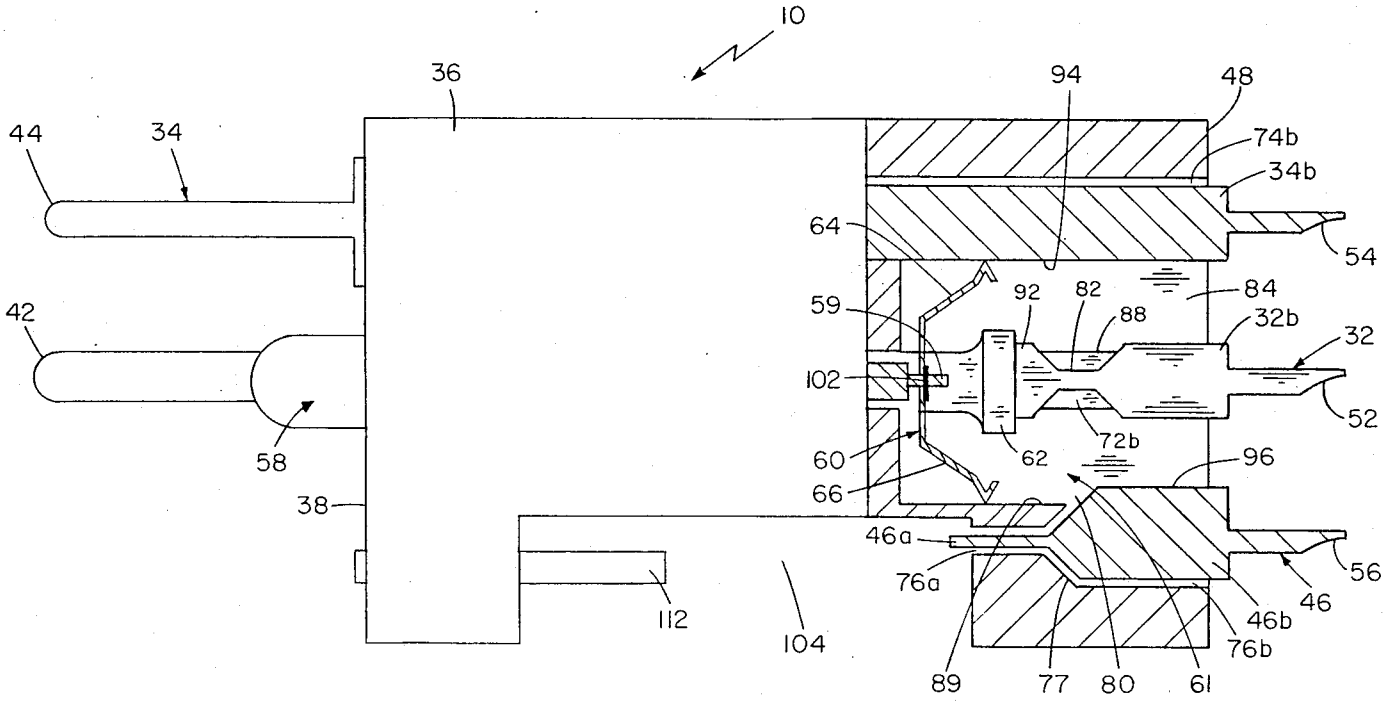
FIG. 5 is a side elevation view of male plug connector 10 with a cross-sectional view of a portion of male connector 10 taken along line 5—5 of FIG. 1.

Referring particularly to FIGS. 3 and 4A, the spring biased means 128 previously described is now described in more detail. Spring biased means 128 broadly includes plunger 58, spring 100 and hollow cylindrical passageway or channel 98. More specifically, passageway 98 longitudinally extends through the axis of base 36, from face 38 to cavity 84 for receiving plunger 58. Passageway 98 includes longitudinal segment 98*a* which extends into face 38 and narrower segment 98*b* which extends into cavity 84. Substantially cylindrical plunger 58 having segment 58*a* and narrower segment 58*b*, with spring 100 coaxially positioned over segment 58*b*, is adapted for slidable insertion into passageway 98. Spring 100 is then entrapped within passageway segment 98*a* between passageway segment 98*b* and plunger segment 58*a* . Accordingly, when male connector 10 is interfitted, face 24 of female connector 14 will push plunger segment 58*a* into passageway 98 thereby slidably deflecting segment 58*b* into cavity 84. Conversely, when connector 10 is apart from connector 14 spring 100 will slidably deflect segment 58*b* from cavity 84.

Referring particularly to FIGS. 3, 4A and 5, the axially slidable switch 61 previously discussed is now described in more detail. Axially slidable switch 61 broadly includes: sliding contact member 60; conductive surface areas 92, 94 and 96; and non-conductive surface areas 88 and 89. More specifically, sliding contact memeber 60 having interconnected contact wiper arms 62, 64 and 66, preferably constructed from a resilient conductive material such as a silver plated copper alloy covered with a chromate coating, is connected to extension 59 of plunger segment 58*b* by ring 102. Contact arms 62, 64 and 66 are positioned 90° apart and radially aligned to axially slide over protruding conductive surfaces 92, 94 and 96 of respective electrodes 32, 34 and 46. Contact arms 62 and 66 are also aligned to axially slide over non-conductive surface areas 88 and 89 which are over respective electrodes 32 and 46. The width of contact arm 62 is wider than the diameter of passageway segment 72*b* such that contact arm 62 will not extend from cavity 84 into recessed area 82 of electrode 32 when contact arm 62 slides over non-conductive surface 88. When plunger 58 is deflected from cavity 84, contact arm 62 contacts conductive surface 92 and contact arms 66 contacts non-conductive surface 89. Contact arm 64 always contacts conductive surface 94 of electrode 34 (FIG. 5). Accordingly, only terminals 54 and 52, which are integrally formed from respective electrodes 32 and 34, are in electrical contact during the non-interfit position.

Figure 4B:
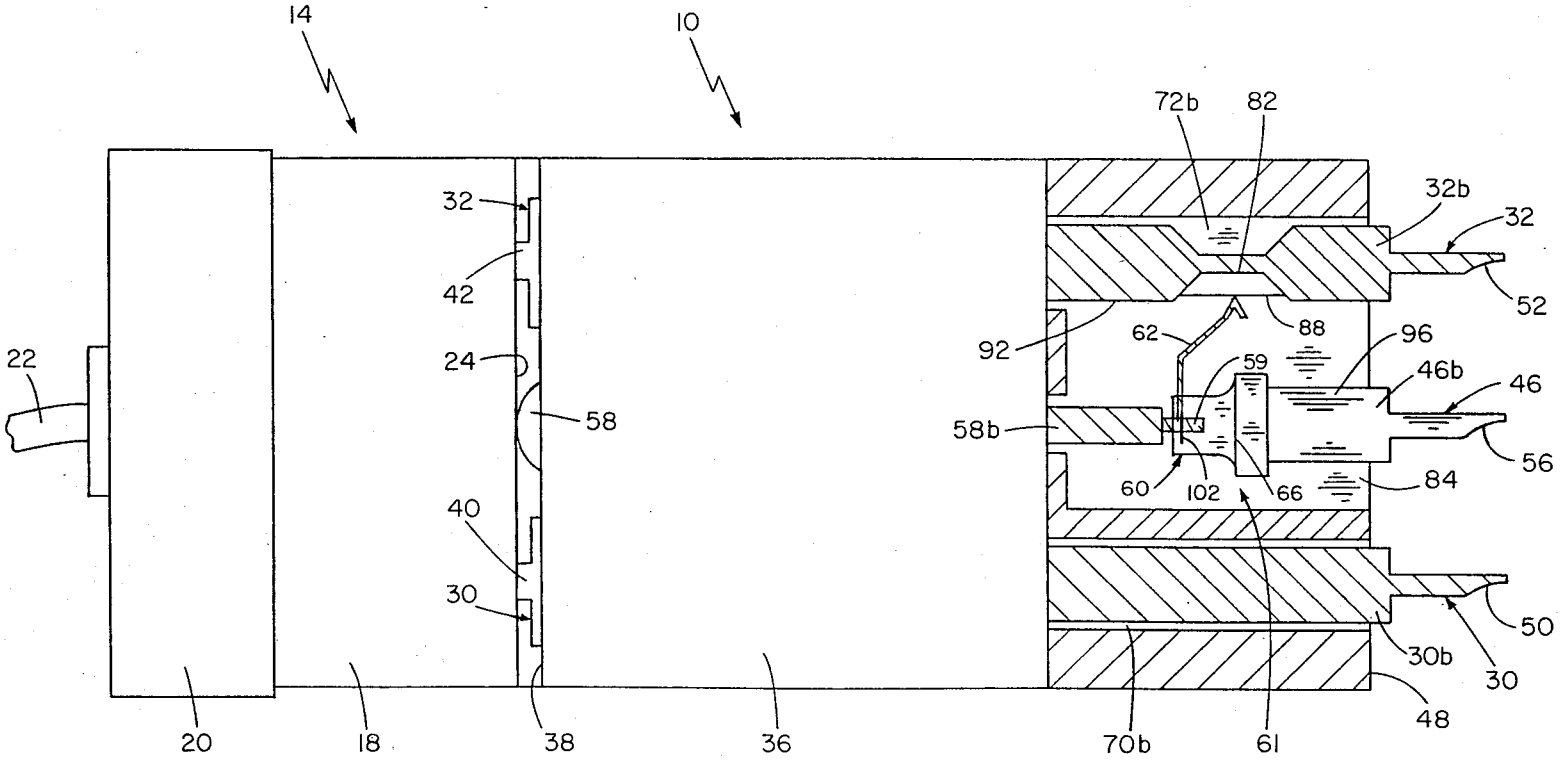
FIG. 4B is a side elevation view of male plug connector 10 interfitted with female receptacle connector 14 with a cross-sectional view of a portion of male connector 10 taken along line 4—4 of FIG. 1.

FIG. 4B illustrates a cross-sectional view of male connector 10 when interfitted with female connector 14. For clarity, housing 68, which would electrically shield connector 10 and a portion of connector 14, is not shown. Plunger 58 is here shown deflected into cavity 84 by face 24 of female connector 14. Accordingly, contact arm 62 is slidably positioned over non-conductive surface area 88. Concurrently, contact arm 66 is slidably positioned in contact with conductive surface 96 of electrode 46. Hence, electrical contact occurs only between terminals 54 and 56, which are integrally formed from electrodes 34 and 46, in the interfit position.

It is apparent from the foregoing that male connector 10 may be easily assembled by slidable insertion of the components internal to base 36 as described above; wiring and soldering of the internal components is not required. Further, the above described electrical switching is both internal to connector 12 and automatic. That is, the switching is dependent only upon interfitting connector 10; separate operator switching or switching by external components is not required.

Referring back to FIGS. 3 and 5, base 36 also includes an indentation 104, groove 106 extending from indentation 104 to face 48, channel 108 extending from indentation 104 to face 38, and screw hole 110 outwardly extending from channel 108 in a perpendicular direction. Ground assembly 112 having threaded screw hole 114 and solder terminal 116 is positioned in channel 108 wherein terminal 116 extends into indentation 104. Ground wire 120 (FIG. 1) from microphone 12 or other electrical device is fitted through groove 106 and soldered to terminal 116. Screw 118 is inserted through hole 122 (not shown) of housing 68 and secured to threaded screw hole 114. Accordingly, housing 68 is electrically grounded thereby electrically shielding male connector 10. In embodiments where connector 10 is coupled to an electrical circuit through a cable, the cable ground wire will be connected to a conventional electrically shielded housing through ground assembly 112.

From the foregoing it will be apparent that in accordance with this invention there has been provided a novel connector with an internal switch which is only actuated by either interfitting or separating the connector. Operator switching is not required. The connector may be used to advantage in a variety of applications in addition to the application described in detail herein. Further, the connector is easily assembled by insertion of the components into a dielectric base, wiring and soldering the connector terminals and pins to the switch is not required.

It will also be apparent from the foregoing that various modifications and changes in the preferred embodiment, shown and described, may be made, and that such changes may be made by those skilled in the art without departing from the spirit of the invention as expressed in the accompanying claims. Therefore, all matters shown and described herein are to be interpreted in an illustrative rather than in a limiting sense.

What is claimed is:

1. An electrical male plug connector for detachable interfittment with an electrical female receptacle connector, comprising:

a substantially cylindrical insulating base having a mating face and an opposing face, said base having a cavity communicating with said mating face;

first and second longitudinal passageways bored through said base between said mating and opposing faces;

a third longitudinal passageway bored through said base from said cavity to said opposing face;

first and second electrical conductors respectively positioned in said first and second passageways, said first and seocnd conductors protruding from said mating face respectively providing first and second pins for mating with said female receptacle connector, said first and second conductors also protruding from said opposing face providing first and second conductor terminals;

a third electrical conductor positioned in said third passageway and protruding from said opposing face providing a third conductor terminal;

an axially slidable switch positioned within said cavity, said switch having a single pole electrically connected to said second conductor, said switch electrically connected said first conductor to said second conductor in a first axial position and electrically connecting said second conductor to said third conductor in a second axial position; and spring biased means extendable from said mating face and responsive to interfittment of said male plug connector with said female receptacle connector for moving said switch axially between said first and second positions.

2. An electrical male plug connector for detachable insertion into the conductive receptacles on the face of a female connector, comprising:

a substantially cylindrical insulating base having a mating face and an opposing face, said base also having a cavity;

first and second longitudinal passageways bored through said base between said mating and opposing faces, said first and second passageways also extending through said cavity;

a third longitudinal passageway bored through said base between said cavity and said opposing face;

first and second electrodes respectively positioned in said first and second passageways, said first and second electrodes protruding from said mating face respectively providing first and second pins for mating with said female connector, said first and second electrodes also protruding from said opposing face providing first and second conductor terminals;

a third electrode positioned in said third passageway and protruding from said opposing face providing a third conductor terminal;

a longitudinal channel bored through said base between said mating face and said cavity;

a plunger slidably positioned in said channel, said plunger protruding beyond said mating face and being adapted to be slidably deflected into said cavity by said female face when said male connector pins are inserted into said female conductive receptacles;

a spring connected between said plunger and said base to slidably deflect said plunger out of said cavity when said male connector pins are disconnected from said female conductive receptacles; and an axially slidable switch positioned within said cavity and coupled to said plunger, said switch having a single pole electrically connected to said second electrode, said switch electrically connecting said first electrode to said second electrode in response to deflection of said plunger out of said cavity and electrically connecting said second electrode to said third electrode in response to deflection of said plunger into said cavity.

3. The male plug connector recited in claim 2 further comprising a substantially cylindrical electrical shield surrounding said base and a portion of said first and second pins.

4. An electrical male plug connector for detachable insertion into the conductive receptacles on the face of a female connector, comprising:

a substantially cylindrical insulating base having a mating face and an opposing face, said base also having a cavity;

first and second longitudinal passageways bored through said base between said mating and opposing faces, said first and second passageways also extending through said cavity;

a third longitudinal passageway bored through said base between said cavity and said opposing face;

first and second electrodes respectively positioned in said first and second passageways, said first and second electrodes protruding from said mating face respectively providing first and second pins for mating with said female connector, said first and second electrodes also protruding from said opposing face providing first and second conductor terminals;

a third electrode positioned in said third passageway and protruding from said opposing face providing a third conductor terminal;

said first electrode having a non-conductive surface area formed over a portion of said first electrode within said cavity;

said third electrode having non-conductive surface area formed over a portion of said third electrode within said cavity;

a longitudinal channel bored through said base between said mating face and said cavity;

a plunger slidably positioned in said channel, said plunger protruding beyond said mating face and being adapted to be slidably deflected into said cavity by said female face when said male connector pins are inserted into said female conductive receptacles;

a spring connected between said plunger and said base to slidably deflect said plunger out of said cavity when said male connector pins are disconnected from said female conductive receptacles;

a conductive contact member connected to said plunger and positioned in said cavity having first, second and third electrically interconnected contact arms respectively adapted to slidably contact said first, second and third electrodes, said first contact arm contacting said non-conductive area of said first conductor and said third contact arm electrically contacting said third electrode when said plunger is deflected into said cavity, said first contact arm electrically contacting said first electrode and said third contact arm contacting said non-conductive surface area of said third electrode when said plunger is deflected out of said cavity, said second contact arm always contacting said second electrode.

5. The electrical male plug connector recited in claim 4 further comprising:

a fourth longitudinal passageway bored through said base between said mating and opposing faces; and a fourth electrode positioned in said fourth passageway, said fourth electrode protruding from said mating face providing a third pin for mating with said female connector, said fourth electrode also protruding from said opposing face providing a fourth terminal.

* * * * *